US005737806A

United States Patent [19]

Leifeld et al.

[11] Patent Number: 5,737,806

[45] Date of Patent: Apr. 14, 1998

[54] APPARATUS FOR TREATING FIBER AND PRODUCING A FIBER LAP THEREFROM

[75] Inventors: Ferdinand Leifeld, Kempen; Stefan Schlichter, Viersen, both of Germany

[73] Assignee: Trützschler GmbH & Co. Kg, Monchen-Gladbach, Germany

[21] Appl. No.: 735,948

[22] Filed: Oct. 23, 1996

Related U.S. Application Data

[63] Continuation-in-part of Ser. No. 448,679, May 24, 1995, abandoned.

[30] Foreign Application Priority Data

May 26, 1994 [DE] Germany ..... 44 18 377.1

[51] Int. Cl.[6] ..... D01G 15/46; D01G 23/04

[52] U.S. Cl. ..... 19/98; 19/305; 19/105

[58] Field of Search ..... 19/200, 203, 204, 19/205, 105, 106 R, 305, 307, 308, 98, 99; 209/21, 27, 149; 409/162; 131/109.1

[56] References Cited

U.S. PATENT DOCUMENTS

| | | | |
|---|---|---|---|
| 2,181,535 | 11/1939 | Schlipp et al. | 19/102 |
| 3,729,290 | 4/1973 | Dillies | 19/99 X |
| 3,862,472 | 1/1975 | Norton et al. | 19/305 X |
| 4,314,387 | 2/1982 | Löffler | 19/104 X |
| 4,355,439 | 10/1982 | Ejtebanell | 19/107 X |
| 4,414,710 | 11/1983 | Bolen | 19/105 |
| 4,524,492 | 6/1985 | Elliott | 19/107 |
| 4,539,728 | 9/1985 | Porteal | 19/105 |
| 4,706,338 | 11/1987 | Anspach | 19/105 |
| 4,761,857 | 8/1988 | McFarlane et al. | 19/106 R X |
| 4,785,505 | 11/1988 | Leifeld | 19/105 |
| 5,022,121 | 6/1991 | Rutz | 19/109 X |
| 5,033,165 | 7/1991 | Temburg et al. | 19/200 X |
| 5,255,415 | 10/1993 | Leifeld et al. | 19/107 |
| 5,303,455 | 4/1994 | Leifeld | 19/304 |
| 5,313,688 | 5/1994 | Leifeld et al. | 19/107 |

FOREIGN PATENT DOCUMENTS

| | | |
|---|---|---|
| 0 423 856 | 4/1991 | European Pat. Off. . |
| 3230 | 4/1878 | Germany . |
| 819 373 | 10/1951 | Germany . |
| 30 03 110 | 9/1980 | Germany . |
| 33 46 092 | 7/1984 | Germany . |
| 39 40 073 | 6/1991 | Germany . |
| 41 30 147 | 3/1992 | Germany . |
| 92 18 356 | 2/1994 | Germany . |
| 43 31 284 | 3/1994 | Germany . |
| 1 278 045 | 6/1972 | United Kingdom . |
| 2 043 725 | 10/1980 | United Kingdom . |
| 2 134 553 | 8/1984 | United Kingdom . |
| 2 214 535 | 9/1989 | United Kingdom . |
| 2 228 495 | 8/1990 | United Kingdom . |
| 2 271 126 | 4/1994 | United Kingdom . |

*Primary Examiner*—Ismael Izaguirre
*Attorney, Agent, or Firm*—Spencer & Frank

[57] ABSTRACT

An apparatus for treating fiber and producing a fiber lap therefrom, includes a fiber feeder; a carding machine including a multi-roll licker-in assembly receiving the fiber material from the feeder, a main carding cylinder receiving fiber material from the licker-in assembly, a plurality of carding flats supported about a circumferential portion of the main carding cylinder and cooperating therewith, and a doffer receiving fiber material from the main carding cylinder; and a fiber lap forming device including a pneumatic fiber stripping device which has a blower for directing an airstream generally tangentially to the doffer for removing and entraining fiber material from the doffer, a hood having an inner face defining a chamber situated above and downstream of said doffer for receiving fiber material carried from the doffer by the airstream, a continuously driven, air-pervious receiving member having an upper face and an underside, and a suction device facing the underside of the receiving member for generating an airstream passing through the receiving member in a direction from the upper face to the underside for drawing fiber material in the chamber onto the upper face of the receiving member for forming a fiber lap thereon.

8 Claims, 5 Drawing Sheets

APPARATUS FOR TREATING FIBER AND PRODUCING A FIBER LAP THEREFROM

CROSS REFERENCE TO RELATED APPLICATION

This application is a continuation-in-part of application Ser. No. 08/448,679 filed May 24, 1995, now abandoned.

BACKGROUND OF THE INVENTION

This invention relates to an apparatus for making a fiber lap, particularly from cotton fibers.

U.S. Pat. No. 5,303,455 issued Apr. 19, 1994 is directed to a fiber treating apparatus in which a fiber lap feeder introduces fiber material to a cleaner formed of three consecutively arranged cleaning rolls. The fiber material is removed by an air stream for the last cleaning roll and is, in a chamber, deposited on a perforated belt whose underside is exposed to a vacuum stream. The perforated belt discharges the cleaned fiber material onto a removal belt in the form of a fiber lap.

It has been found that for producing certain articles, particularly for hygienic purposes, from a fiber cleaned in the above-outlined manner too many and excessively large neps are present and further, the material to be processed is cloudy and lacks the desired uniformity.

Similar disadvantages were found in the end product of a carding machine constructed in accordance with parent application Ser. No. 08/448,679.

SUMMARY OF THE INVENTION

It is an object of the invention to provide an improved apparatus whose end product has a significantly improved opening effect, a better reduction of the quantity and size of neps and also a significantly improved uniformity of the fiber lap.

This object and others to become apparent as the specification progresses, are accomplished by the invention, according to which, briefly stated, the apparatus for treating fiber and producing a fiber lap therefrom, includes a fiber feeder; a carding machine including a multi-roll licker-in assembly receiving the fiber material from the feeder, a main carding cylinder receiving fiber material from the licker-in assembly, a plurality of carding flats supported about a circumferential portion of the main carding cylinder and cooperating therewith, and a doffer receiving fiber material from the main carding cylinder; and a fiber lap forming device including a pneumatic fiber stripping device which has a blower for directing an airstream generally tangentially to the doffer for removing and entraining fiber material from the doffer, a hood having an inner face defining a chamber situated above and downstream of said doffer for receiving fiber material carried from the doffer by the airstream, a continuously driven, air-pervious receiving member having an upper face and an underside, and a suction device facing the underside of the receiving member for generating an airstream passing through the receiving member in a direction from the upper face to the underside for drawing fiber material in the chamber onto the upper face of the receiving member for forming a fiber lap thereon.

Thus, essentially, the invention resides in the combination of part of the construction disclosed in U.S. Pat. No. 5,303,455 and parent application Ser. No. 08/448,679, resulting in an improved product which can be regarded as a result of a synergistic effect of a combination of the two systems.

DESCRIPTION OF THE PREFERRED EMBODIMENTS

Figure 1:
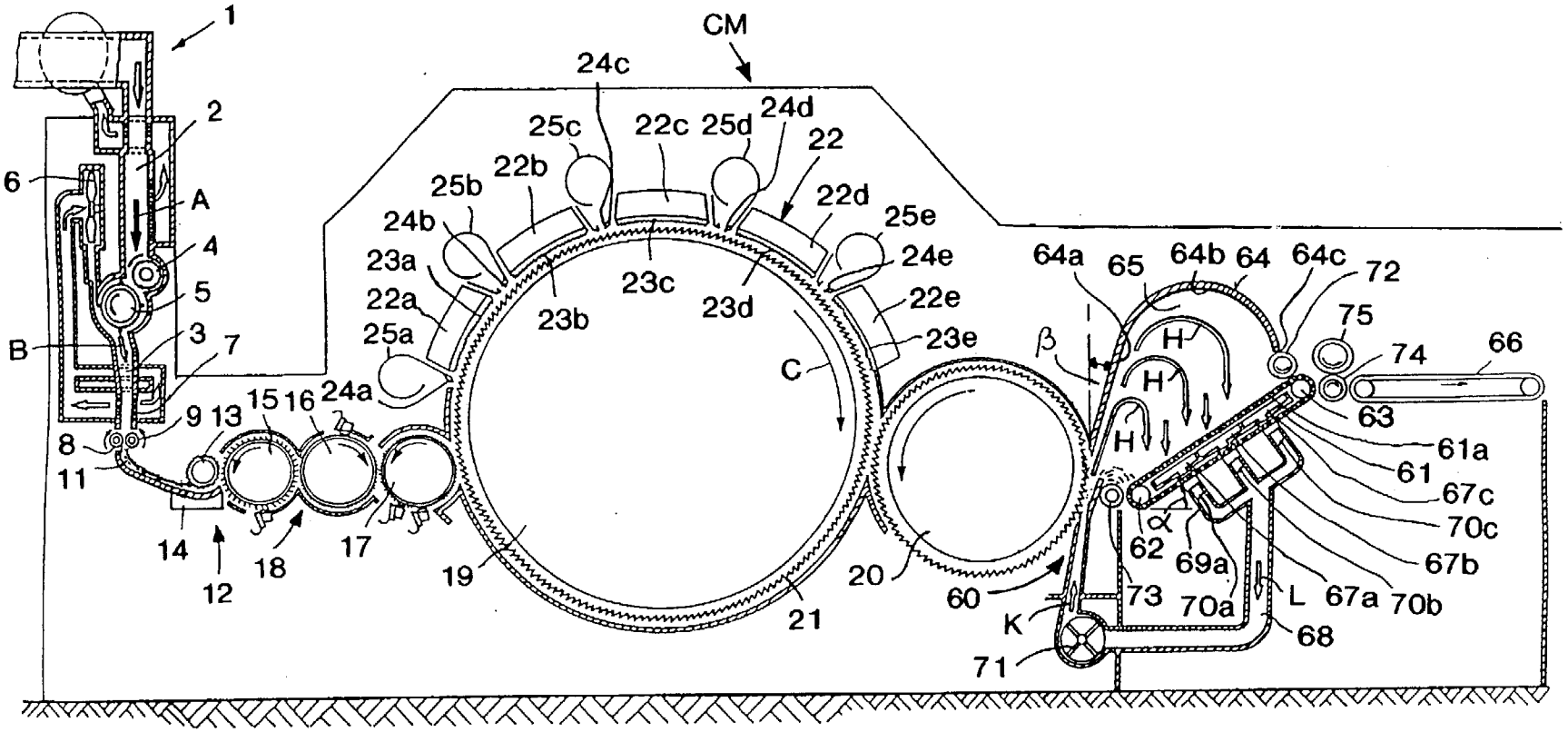
FIG. 1 is a schematic sectional side elevational view of a preferred embodiment of the invention.

Turning to FIG. 1, there is illustrated therein a known fiber tuft feeder 1 which may be, for example, an EXACTAFEED FBK model, manufactured by Trutzschler GmbH & Co. KG, Mönchengladbach, Germany. The fiber tuft feeder 1 has an upper, reserve chute 2 and a lower, feed chute 3 between which a feed roll 4 and an opening roll 5 are positioned, which forward the fiber material A from the reserve chute 2 into the feed chute 3. A fan 6 drives air tangentially past the opening roll 5 into the feed chute 3 for forming an air/fiber mixture B and for densifying the fiber column which builds up in the feed chute 3. The air driven by the fan 6 is recirculated by withdrawing air through apertures 7 provided in a lower part of the feed chute 3. At the bottom end of the feed chute 3 cooperating delivery rolls 8 and 9 are provided which withdraw the fiber material from the feed chute 3 and forward the same onto a guide tray 10 on which the fiber material is, as a preliminary fiber lap 11, advanced to a feeding device 12 composed of a feed roller 13 and a feed table 14 of a conventional carding machine CM which may be, for example, an EXACTACARD DK 760 model, manufactured by Trützschler GmbH & Co. KG, Mönchengladbach, Germany.

The feed roller 13 and the feed table 14 are followed by three serially arranged licker-ins 15, 16 and 17 forming a licker-in assembly 18, a main carding cylinder 19 and a doffer 20.

The carding cylinder 19 has a sawtooth clothing 21 and rotates in the direction designated with the arrow C. The carding cylinder 19 cooperates with stationary flats 22, composed of stationary flats segments **22*a*–22*e* covering one part of the upper circumference of the carding cylinder 19. The clothings 23*a*–23*e* of the flats segments 22*a*–22*e* and the clothing 21 of the carding cylinder 19** cooperate with one another to form a carding zone.

Between the flats segments **22*a*–22*e* a space is provided, that is, the flats segments are, as viewed in the circumferential direction, at a clearance from one another. In each instance, in front of each flats segment—as viewed in the direction of rotation of the carding cylinder 19—respective mote knives 24*a*–24*e* are provided to separate waste, trash and the like. Each mote knife is associated with a respective suction hood 25*a*–25*e*. The cutting edge of the mote knives is in each instance oriented opposite the rotary direction C of the carding cylinder 19**. The distance of the mote knives to the carding cylinder determines the intensity of the waste separation. In case of a very small distance, in addition to shell fragments and short fibers the finest dust particles (microdust) are also removed. In case of a larger distance of the mote knives from the carding cylinder less microdust is removed. The setting distance may lie between 0.1 and 2.5 mm.

Figure 2:
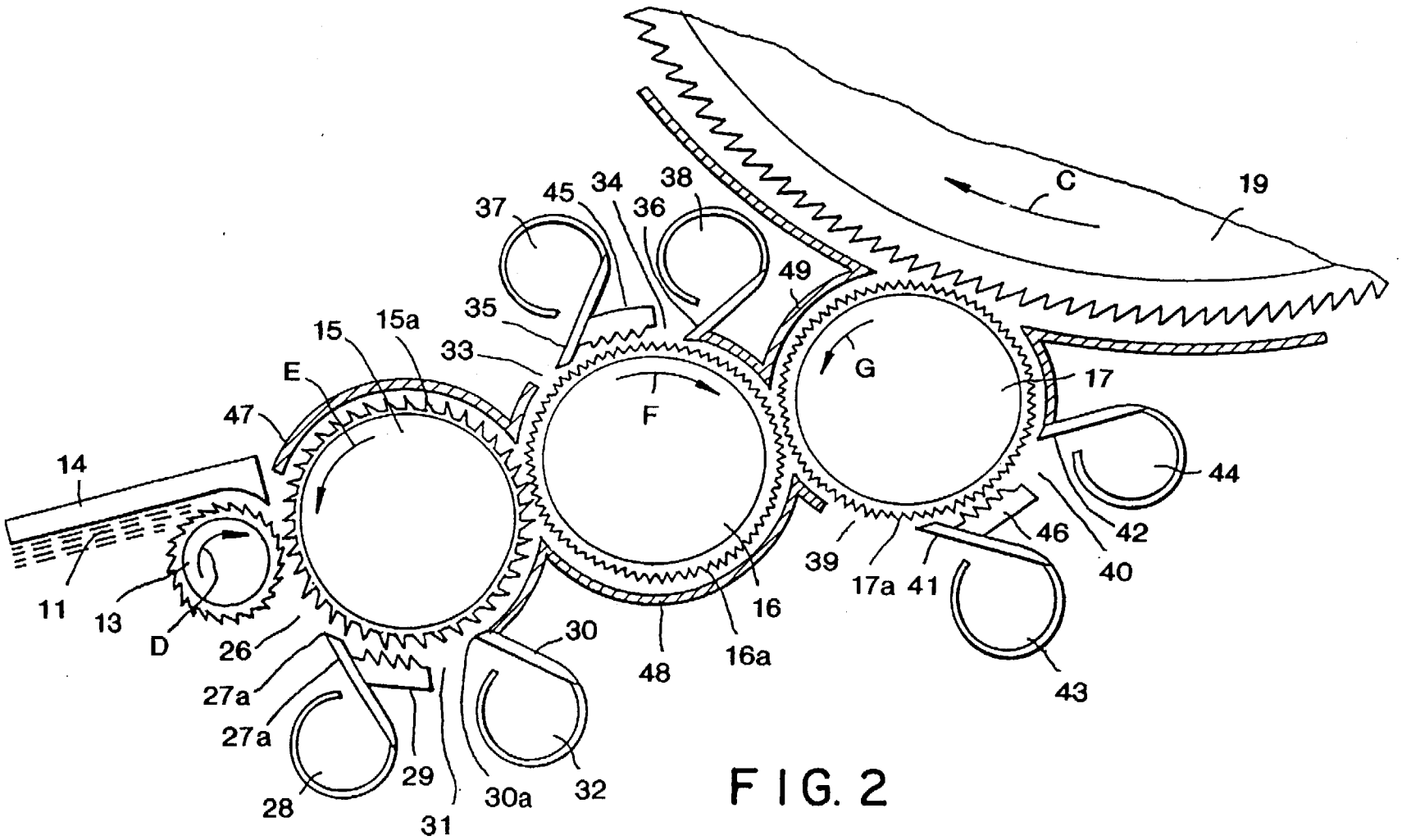
FIG. 2 is a schematic sectional side elevational view of some of the components of the preferred embodiment of the invention.

Turning to FIG. 2, the fiber lap 11, held firmly between the feed table 14 and the feed roller 13 is, by virtue of the rotation of the feed roller 13 in the direction of the arrow D, advanced slowly in the direction of the rapidly rotating licker-in 15 which is a pin roll. The pins 15*a* of the pin roll 15 penetrate into the fiber lap 11 and remove fibers which are further transported by the pins 15*a*. The pin roll 15 rotates with a significantly higher speed than the feed roll 13 in a direction indicated by the arrow E, that is, opposite to the direction of rotation D of the feed roll 13. The removed fibers pass by the waste discharge opening 26 where at the separating edge 27*a* of the mote knife 27 waste is removed which is further transported away by a suction device 28. Thereafter, the fibers pass through a stationary carding element 29 before further waste removal is effected by the separating edge 30*a* of a mote knife 30. Waste is discharged through the discharge opening 31, aided by the suction device 32. Then the fiber material moves onto the subsequent licker-in 16 which is provided with a sawtooth clothing 16*a*. The licker-in 16 too, is provided with waste discharge openings 33, 34, mote knives 35, 36 and suction devices 37, 38. The licker-in 16 rotates at a higher speed than the licker-in 15.

The licker-in 16 which rotates in the direction of the arrow F transfers the fibers to the licker-in 17 rotating in the opposite direction as indicated by the arrow G. The licker-in 17 too, is provided with a sawtooth clothing 17*a* which, however, is finer than that on the licker-in 16. The licker-in 17, which is associated with waste discharge openings 39, 40, mote knives 41, 42 and suction devices 43, 44, transfers the fibers to the carding cylinder 19. The waste discharge openings 34 and 40 are preceded by respective stationary carding elements 45 and 56, respectively. All the licker-ins 15, 16 and 17 are provided with covers 47, 48, and 49 to the extent possible.

Figure 3:
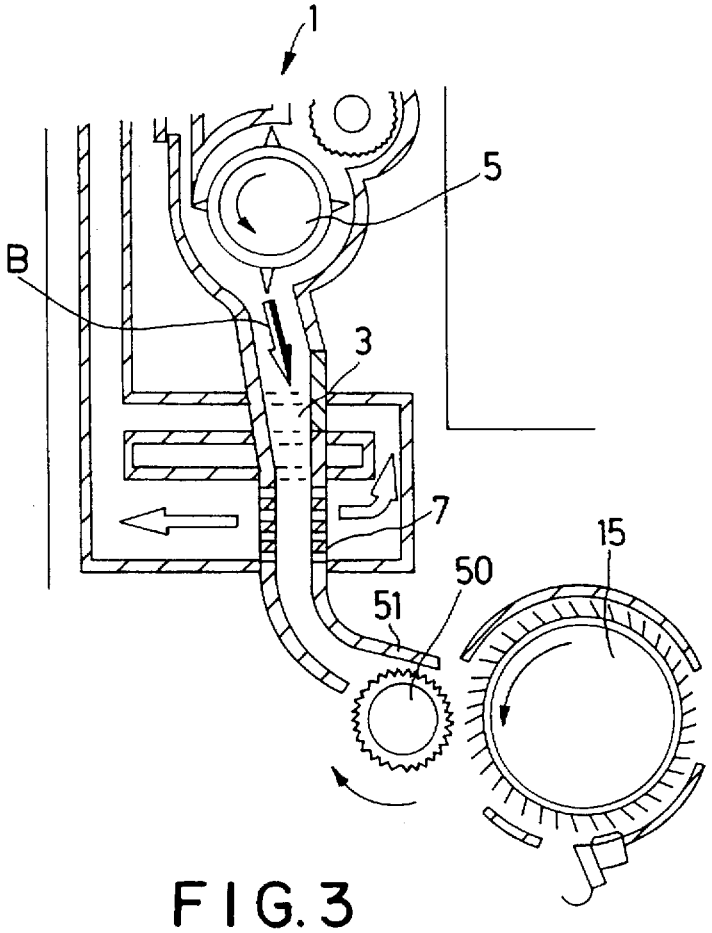
FIG. 3 is a fragmentary sectional side elevational view of a variant of the card feeder shown in FIG. 1.

FIG. 3 illustrates the modified downstream end of the fiber tuft feeder 1. In this arrangement the delivery rolls 8 and 9 are replaced by a single feed roller 50 which, in cooperation with a feed tray 51 forming a terminus of the feed chute 3, advances the fiber lap to the licker-in 15 of the carding machine CM (not shown in FIG. 3). Thus, the feed roller 50 has the dual role of withdrawing the fiber material from the feed chute 3 and advancing it directly to the licker-in 15.

Figure 4:
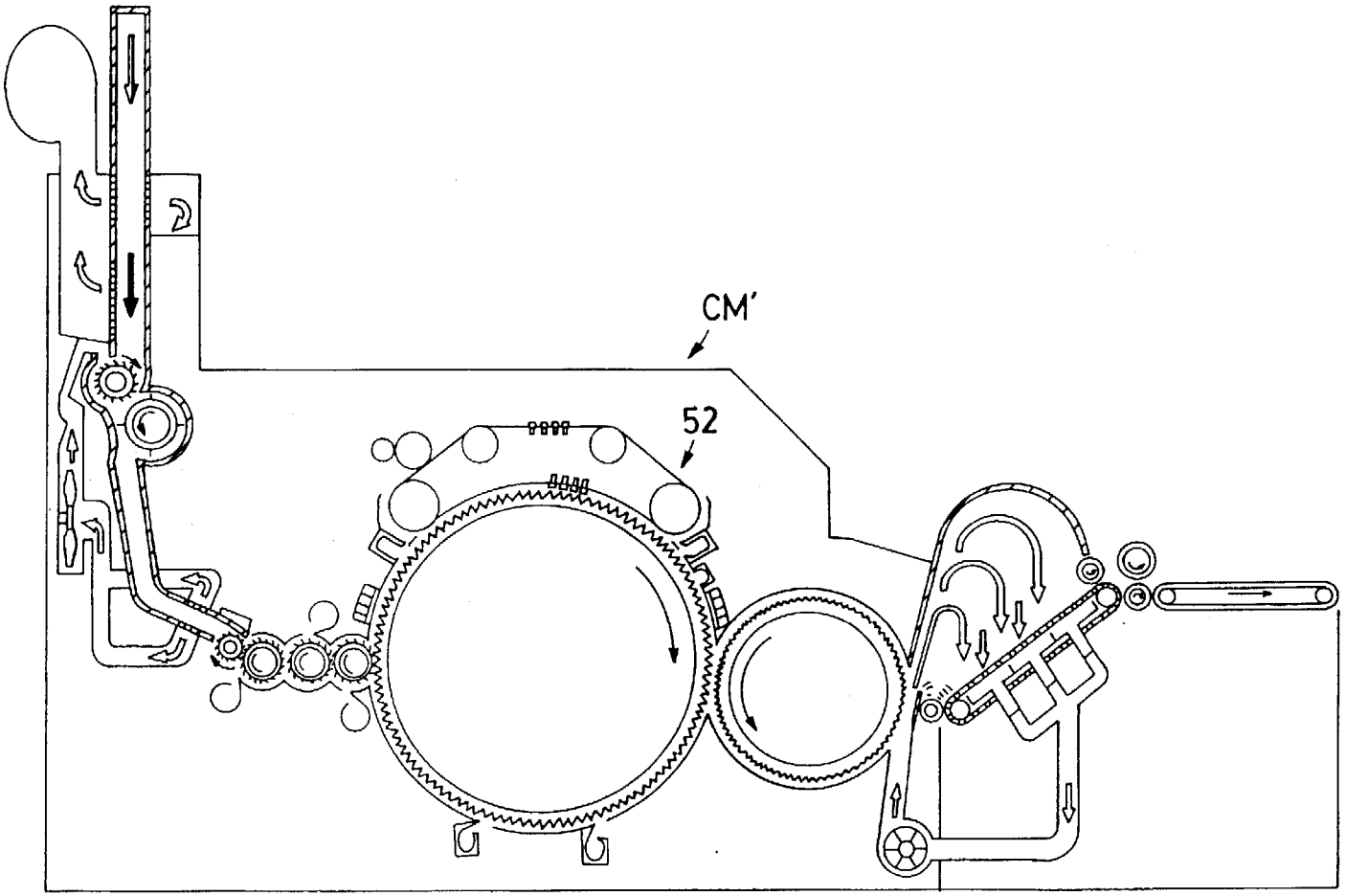
FIG. 4 is a schematic sectional side elevational view of another preferred embodiment of the invention.

In the embodiment according to FIG. 4, the carding machine CM of FIG. 1, having stationary flats 22*a*–22*e* is replaced by a carding machine CM' provided with conventional travelling flats generally designated at 52.

Reverting to FIG. 1, the doffer 20 of the carding machine CM is associated with a pneumatic fiber-stripping device generally designated at 60 for ejecting the fibers upwardly from the doffer 20. Downstream of the fiber-stripping device 60 an endless screen belt 61 is arranged, supported by end rollers 62 and 63. The screen belt 61 is inclined upwardly at an angle $\alpha$ to the horizontal in the working direction. Above the screen belt 61 a downwardly open hood 64 is provided which encloses a receiving chamber 65 into which the fiber is thrown from the doffer 20 by the stripping device 60. The hood 64 has an inner wall surface portion 64*a* which extends upwardly from the doffer 20 and which is inclined at an angle $\beta$ to the vertical and extends over the screen belt 61. Thus, the inner wall surface 64*a* is inclined toward the screen belt 61 at an acute angle of $90-(\alpha+\beta)$ degrees. The upper end of the inner wall surface 64*a* is adjoined by a curved inner wall surface 64*b* closing the hood 64 and terminating adjacent the upper end of the screen belt 61. The fiber material is guided by the air stream of the stripping device 60 along the rising inner wall surface portion 64*a* of the hood 64 and is directed as an air/fiber mixture, in a distribution shown by arrows H, onto the upper surface of the working flight 61*a* of the screen belt 61. A fiber lap removal device 66 comprising, for example, a conveyor belt, is arranged downstream of the screen belt 61.

The fiber stripping device 60 is arranged tangentially to the doffer 20 and directs an air stream K in the upward direction. The underside of the working flight 61*a* of the screen belt 61 is exposed to suction by serially arranged suction boxes 67*a*, 67*b* and 67*c* which are coupled to a common suction conduit 68 by individual suction conduits 69*a*, 69*b* and 69*c*, respectively. Each suction conduit 69*a*, 69*b* and 69*c* accommodates a respective throttle gate 70*a*, 70*b* and 70*c* for setting the flow rate of the suction stream for each suction box 67*a*, 67*b* and 67*c*.

Between the suction conduit 68 and the fiber stripping device 60 a fan 71 is provided which supplies, in recirculation, the stripping air stream K, the conveying air stream H as well as the suction air stream L. At the discharge end of the screen belt 61 there is provided, between the end roller 63 and the lower boundary of the receiving chamber 65, a sealing roller 72 which is situated between the upper face of the belt flight 61*a* and a terminal edge 64*c* of the hood 64 to obturate the clearance between the belt 61 and the hood 64. Further, at the upstream end of the screen belt 61, between the fiber stripping device 60 and the doffer 20, a sealing roller 73 is provided which obturates the space between the outlet of the stripping device 60 and the screen belt 61. Between the screen belt 61 and the fiber lap removing device 66 two cooperating calender rollers 74 and 75 are provided. As an alternative to the screen belt, it is feasible to use a rotary screen drum which is exposed to suction by a vacuum device situated inside the drum.

Figure 5:
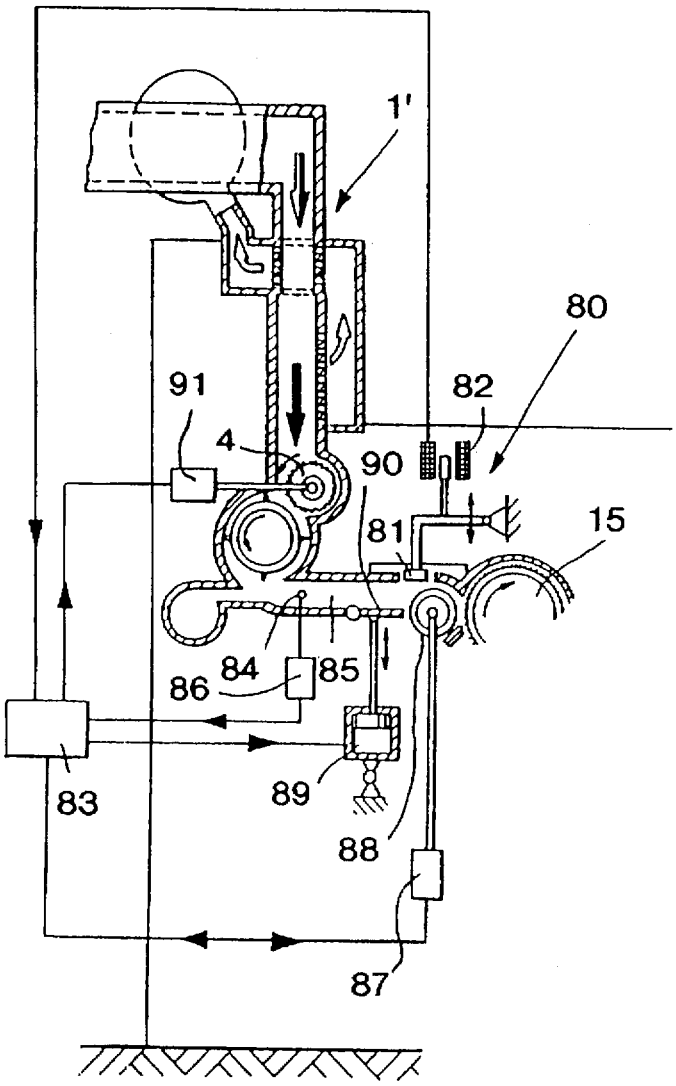
FIG. 5 is a sectional side elevational view, with block diagram, of another preferred embodiment of the card feeder shown in FIG. 1.

Turning to FIG. 5, in the embodiment illustrated therein a device 80 for regulating the thickness of a preliminary fiber lap is situated immediately upstream of the input side (represented by the licker-in 15) of the carding machine CM. The measuring member 81 cooperates with an inductive path sensor 82 which, in turn, is electrically connected with a control and regulating device 83. Further, a pressure sensor 84 arranged in the horizontal feed chute 85 applies sensor signals via a transducer 86 to the control and regulating device 83. The latter, in turn, controls a speed variable motor 87 which operates the feed roller 88 functioning as the feed roller 50 of FIG. 3. The control and regulating device 83 also controls a pneumatic cylinder unit 89 for varying the width of the feed chute 85 in the zone of the air outlet openings 90, as well as the rpm of a motor 91 driving the feed roll 4 of the fiber tuft feeder 1'.

It will be understood that the above description of the present invention is susceptible to various modifications, changes and adaptations, and the same are intended to be comprehended within the meaning and range of equivalents of the appended claims.

What is claimed is:

1. An apparatus for treating fiber and producing a fiber lap therefrom, comprising in combination (a) fiber feeding means for advancing fiber material in a feeding direction;

(b) a carding machine including (1) a licker-in assembly disposed downstream of said fiber feeding means as viewed in said feeding direction for receiving the fiber material from said feeding means; said licker-in assembly including at least two licker-ins arranged in a series in said feeding direction; any said licker-in cooperating as a take-over and opening roll with an immediately upstream-arranged said licker-in as viewed in said feeding direction;

(2) a main carding cylinder receiving fiber material from said licker-in assembly;

(3) a plurality of carding flats supported about a circumferential portion of said main carding cylinder and cooperating therewith; and (4) a doffer receiving fiber material from said main carding cylinder; and (c) a fiber lap forming device including (1) a pneumatic fiber stripping device including blowing means for directing an airstream generally tangentially to the doffer for removing and entraining fiber material from said doffer;

(2) a hood having an inner face defining a chamber situated above and downstream of said doffer for receiving fiber material carried from said doffer by said airstream;

(3) an air-pervious receiving member having an upper face and an underside; said receiving member being disposed in said chamber downstream of said doffer;

(4) means for continuously moving said receiving member; and (5) suction means facing said underside of said receiving member for generating an airstream passing through said receiving member in a direction from said upper face to said underside for drawing fiber material in said chamber onto said upper face of said receiving member for forming a fiber lap thereon.

2. The apparatus as defined in claim 1, wherein said carding flats are stationary flats.

3. The apparatus as defined in claim 1, wherein said carding flats are travelling flats.

4. The apparatus as defined in claim 1, wherein said licker-ins consist of a first, second and third licker-in as viewed in said feeding direction.

5. The apparatus as defined in claim 4, wherein said first licker-in is a pin roll and said second and third licker-ins are sawtooth rolls.

6. The apparatus as defined in claim 1, wherein said fiber feeding means comprises (a) a card feeder having a feed chute having a discharge end and a pair of cooperating withdrawing rollers situated at said discharge end for pulling fiber material out of said feed chute; and (b) a feed roller receiving fiber material from said withdrawing rollers and introducing the fiber material directly into said licker-in assembly.

7. The apparatus as defined in claim 1, wherein said fiber feeding means comprises a card feeder including a feed chute having a discharge end and a withdrawing roller situated at said discharge end for pulling fiber material out of said feed chute and for introducing the fiber material directly into said licker-in assembly.

8. The apparatus as defined in claim 1, wherein said lap forming device further comprises a device for removing said fiber lap from said receiving member.

* * * * *